US005506670A

United States Patent [19]

Hatano

[11] Patent Number: 5,506,670

[45] Date of Patent: Apr. 9, 1996

[54] DUPLEX COPYING MACHINE WITH AIR BLOWER FOR AN INTERMEDIATE TRAY

[75] Inventor: Masaru Hatano, Osaka, Japan

[73] Assignee: Mita Industrial Co., Ltd., Osaka, Japan

[21] Appl. No.: 414,324

[22] Filed: Mar. 31, 1995

[30] Foreign Application Priority Data

Apr. 7, 1994 [JP] Japan ..... 6-069653

[51] Int. Cl.[6] ..... G03G 15/00; B65H 3/12

[52] U.S. Cl. ..... 355/319; 271/96

[58] Field of Search ..... 355/23, 24, 313, 355/319, 320; 271/3.03, 3.07, 96, 98, 97

[56] References Cited

U.S. PATENT DOCUMENTS 4,566,683 1/1986 Moore ..... 271/98
5,088,713 2/1992 Hayashi ..... 271/3.03
5,098,077 3/1993 Russel ..... 271/3.07 X
5,176,373 1/1993 Namba ..... 271/3.03 X

*Primary Examiner*—Joan H. Pendegrass
*Assistant Examiner*—Quana Grainger
*Attorney, Agent, or Firm*—Beveridge, DeGrandi, Weilacher & Young

[57] ABSTRACT

A duplex copying machine that includes an automatic document feeder and a sheet feeder for conveying sheets, which each have an original image copied on one surface, toward a photoreceptor. The sheet feeder blows air on the leading end of the lowermost sheet out of a plurality of sheets set on a sheet tray by way of an air blowing fan to separate the lowermost sheet from the sheets above the lowermost sheet. The amount of air blown by the air blowing fan in situations where the automatic document feeder is not used and the sheets (each having an original image copied on one surface) are being successively stacked on the sheet tray is made smaller than the larger amount of air used in the situation where the sheets are being conveyed.

4 Claims, 9 Drawing Sheets

DUPLEX COPYING MACHINE WITH AIR BLOWER FOR AN INTERMEDIATE TRAY

CROSS REFERENCE TO RELATED APPLICATION

This application claims priority benefits under 35 USC §119 of Japanese Patent Application Serial No. 6-69653, the disclosure of which is incorporated by reference.

BACKGROUND OF THE INVENTION

1. Field of the Invention

The present invention relates to a copying machine comprising an automatic document feeder and a sheet feeder for successively conveying the lowermost sheet out of a plurality of sheets stacked on a sheet tray after an original image is copied on one of their surfaces while blowing air on the leading end of the lowermost sheet to separate the lowermost sheet from the remaining sheets.

2. Description of the Related Art

In order to cope with recent higher speed requirements, the so-called stacking feed operation, in which a stacking operation on a sheet tray and a refeeding operation from the sheet tray are simultaneously performed at the time of duplex copying using an automatic document feeder, has been performed in the above described copying machine.

Furthermore, in a sheet feeder in the above described copying machine, the leading ends of a plurality of sheets above the lowermost sheet are raised by blown air to separate the lowermost sheet from the sheets above the lowermost sheet. The above described blown air is basically required only when sheets are fed again.

On the other hand, certain time (which can be considered a loss in time) is required for an air blowing fan to reach a rated state where a predetermined amount of air is obtained after the driving of the air blowing fan is started. At the time of the above described stacking feed operation for achieving higher speed, such a loss of time is not allowed. Therefore, the air blowing fan is continuously driven to obtain a predetermined amount of air immediately when required.

When the air blowing fan is thus continuously driven, however, the blown air may adversely affect the sheets which are being stacked on the sheet tray.

On the other hand, at the time of duplex copying without using the automatic document feeder, an operator turns an original over when the copying on one of the surfaces of the sheets is terminated, followed by copying on the reverse surfaces thereof. Therefore, a predetermined time period is always required from the termination of the copying on one of the surfaces of the sheets to the start of the copying on the reverse surfaces thereof. Consequently, the sheets, each having an original image copied on its one surface, have been stacked on the sheet tray a predetermined time period before the refeeding of the sheets from the sheet tray is started.

In such a case, it is useless to continuously drive the air blowing fan by the same amount of air as the amount of air after the refeeding from the time before the refeeding is started in the same manner as that in the case of the stacking feed. In addition, the blown air exerts an unnecessary adverse effect on the sheets which are being stacked on the sheet tray, which may result in poor stacking of the sheets.

SUMMARY OF THE INVENTION

An object of the present invention is to provide a duplex copying machine capable of reliably preventing poor stacking of sheets and which is also useful in saving energy when an automatic document feeder is not used.

In order to attain the above described object, a duplex copying machine in accordance with one aspect of the present invention is characterized by comprising an automatic document feeder for automatically conveying an original set on an original setting section to an exposed area, a sheet feeder comprising i) a sheet tray on which a plurality of sheets each having an original image copied on its one surface are stacked, ii) air blowing means for blowing air on the leading end of the lowermost sheet out of the plurality of sheets stacked on the sheet tray to separate the lowermost sheet from the sheets above the lowermost sheet, and iii) conveyer belt means for successively conveying the separated lowermost sheet toward image forming means, mode detecting means for discriminating between a use mode in which the automatic document feeder is used and a non-use mode in which it is not used, and air amount controlling means for making the amount of air blown by the air blowing means smaller than the amount of air in a case where the sheets are conveyed by the conveyer belt means when the conditions under which the non-use mode is detected by the mode detecting means and the sheets are being at least stacked are satisfied.

In accordance with the present invention, the amount of air blown by the air blowing means in a case where the automatic document feeder is not used and the sheets are being successively stacked is made smaller than the amount of air during refeeding, whereby blown air does not adversely affect the sheets which are being stacked. As a result, it is possible to prevent the sheets from being poorly stacked by the blown air. Moreover, the amount of air in a case where the sheets are being stacked is reduced, thereby to make it possible to reduce energy for driving the air blowing means, as compared with a case where the amount of air is kept constant irrespective of whether or not the sheets are being stacked. As a result, it is possible to save energy.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 2:
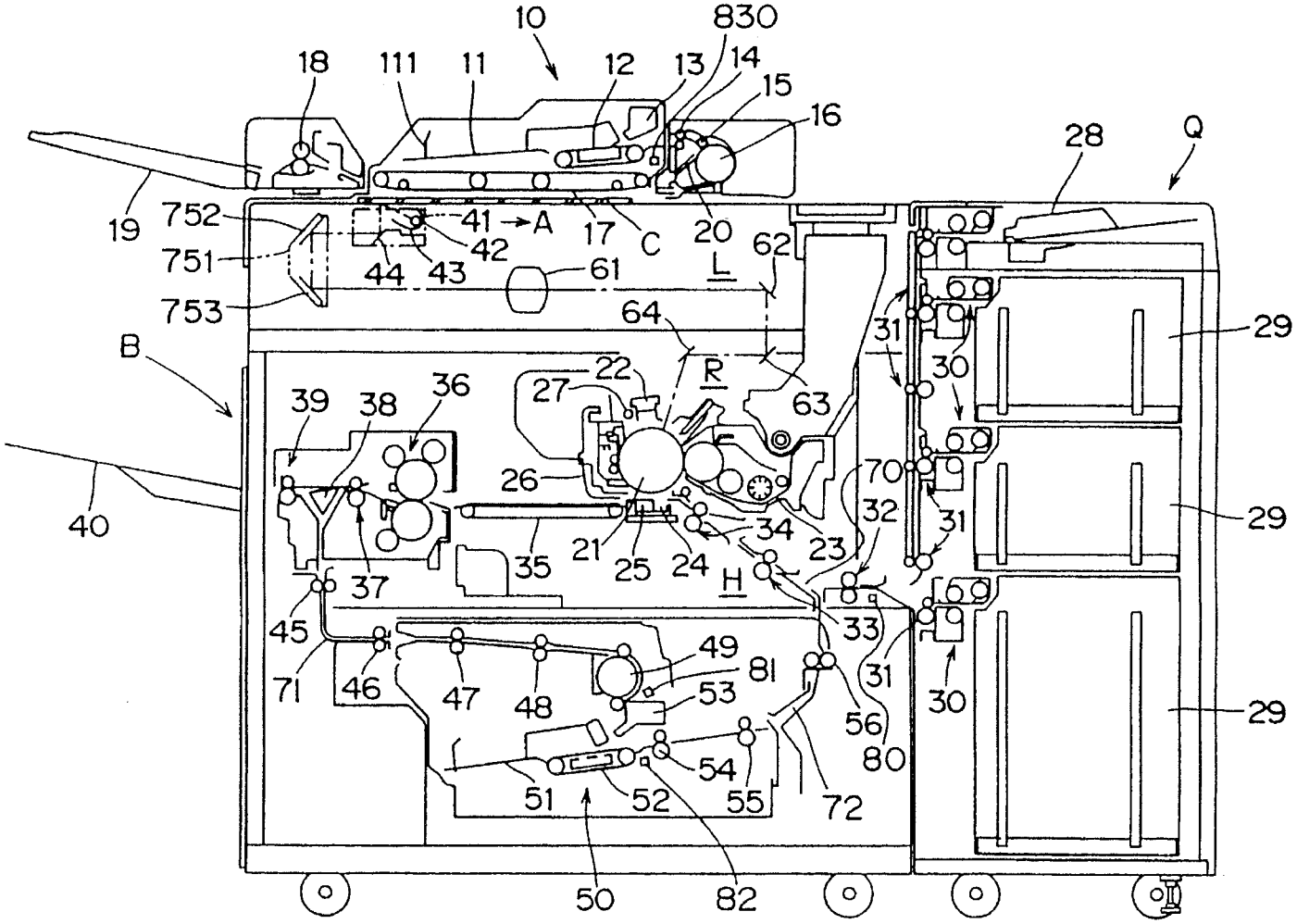
FIG. 2 is a schematic cross sectional view showing the internal construction of the copying machine.

Referring to FIG. 2, a duplex copying machine comprises (1) a main body B, (2) a contact glass C serving as a transparent platen and an RADF (Reversing Automatic Document Feeder) 10 capable of reversing an original which are disposed on the upper surface of the main body B, (3) an optical system L, an image forming section R, a paper refeeding device 50 and a paper conveying device H which are disposed inside the main body B, and (4) a paper feeding device Q which is disposed beside the main body B.

The above described RADF 10 comprises an original platen 11, a suction conveyer belt 12, an air nozzle 13, delivery rollers 14 and 15, a reversing roller 16, a conveyer belt 17, a pair of discharge rollers 18, a paper discharge tray 19, and the like. In the RADF 10, in the case of copying of one-sided originals, the lowermost original out of a plurality of originals set on the original platen 11 is separated from the originals other than the lowermost original by suction using the suction conveyer belt 12 and blown-off air from the air nozzle 13, and is conveyed onto the contact glass C by the suction conveyer belt 12, the delivery rollers 14 and 15, the reversing roller 16 and the conveyer belt 17. A paper trailing end liner 111 for lining up the trailing ends of the originals set on the original platen 11 is slidably provided on the original platen 11. Reference numeral 830 denotes an original set detecting sensor for determining that originals are set on the original platen 11. The original set detecting sensor 830 is constituted by a photosensor or a limit switch.

The original on the contact glass C is scanned by the optical system L, after which the scanned original is discharged to the paper discharge tray 19 by the conveyer belt 17 and the pair of discharge rollers 18. On the other hand, in the case of copying of double-sided originals, the surface of the original is scanned by the optical system L, after which the scanned original is conveyed again by the conveyer belt 17 through a guide 20 to the reversing roller 16, where the original is reversed, and is so conveyed that the reverse surface thereof is opposed to the contact glass C, while the reverse surface of the original is scanned by the optical system L in this state, after which the scanned original is discharged to the paper discharge tray 19, by the same operation as that in the above described case of copying of one-sided originals. The detailed construction of the suction conveyer belt 12 and the air nozzle 13 will be described later.

The optical system L comprises a first moving frame 41 comprising a halogen lamp 42, a reflecting plate 43 and a mirror 44, a second moving frame 751 comprising mirrors 752 and 753, a lens section 61, and fixed mirrors 62, 63 and 64. The optical system L causes the halogen lamp 42 to emit light if a copying operation is started, and moves the moving frames 41 and 751 at respective predetermined speeds in the direction of scanning (a direction indicated by an arrow A in FIG. 2) so as to scan the original on the contact glass C. The original on the contact glass C is irradiated by the light from the halogen lamp 42. The light is reflected from the original, and is introduced into the lens section 61 through the mirrors 44, 752 and 753, to expose a photosensitive drum 21.

The image forming section R comprises the photosensitive drum 21, and a charging section 22, a developing section 23, a transferring section 24, a separating section 25, a cleaning section 26, a charge eliminating section 27, and the like which are provided around the photosensitive drum 21. The periphery of the photosensitive drum 21 is charged to a predetermined potential by the charging section 22, whereby an electrostatic latent image of the original is formed by the above described exposure. The electrostatic latent image is developed into a toner image by the adhesion of charged toner particles in the developing section 23. The toner image is transferred onto paper sheets which are conveyed from the paper feeding device Q.

The paper feeding device Q comprises a manual paper setting section 28, a plurality of paper feeding sections 29, a group of pairs of paper feeding rollers 30, a group of pairs of delivery rollers 31, and the like. In the paper feeding device Q, the paper sheets are fed to a pair of delivery rollers 32 from the manual paper setting section 28 or the paper feeding sections 29 by the group of pairs of paper feeding rollers 30 and the group of pairs of delivery rollers 31.

Furthermore, a pair of delivery rollers 33, a pair of registration rollers 34, a conveyer belt 35, a fixing device 36, a pair of delivery rollers 37, a switching guide 38, a pair of discharge rollers 39, a paper discharge tray 40, and the like are disposed in this order from the upstream side in the direction of conveyance as the paper conveying section H. In the paper conveying section H, the paper sheets are fed to the photosensitive drum 21 from the paper feeding device Q by the pairs of delivery rollers 32 and 33 and the pair of registration rollers 34, and toner particles on the photosensitive drum 21 are transferred when the paper sheet passes through the position of the transferring section 24.

In the case of copying on only one of the surfaces of the paper sheets, the paper sheet on which the toner image is transferred is separated from the photosensitive drum 21 by the separating section 25, and is conveyed by the conveyer belt 35 to the fixing device 36, where the toner image is fixed, after which the paper sheet is discharged to the paper discharge tray 40 by the pair of delivery rollers 37 and the pair of discharge rollers 39. On the other hand, in the case of copying on both surfaces of the paper sheets, the switching guide 38 is switched to the side of the paper refeeding device 50. The paper sheet after the fixing is conveyed to the paper refeeding device 50 through a stacking and conveying path 71 from the switching guide 38.

The paper refeeding device 50 comprises pairs of delivery rollers 45 to 48, a reversing roller 49, a sheet tray 51, a suction conveyer belt 52, an air nozzle 53, pairs of delivery rollers 54 to 56, and the like in this order from the upstream side in the direction of conveyance. The paper sheet is conveyed to the reversing roller 49 by the pairs of delivery rollers 45 to 48, and is stacked on the sheet tray 51 with its reverse surface directed downward by the reversing roller 49. A conveying path from the pair of delivery rollers 45 to the sheet tray 51 is the above described stacking and conveying path 71.

If a copying operation on the reverse surface of the paper sheet is started, only the lowermost paper sheet out of a plurality of paper sheets stacked on the sheet tray 51 is separated from the remaining paper sheets by suction using the suction conveyer belt 52 and blow-off air from the air nozzle 53. The separated lowermost paper sheet is fed to the photosensitive drum 21 through a paper refeeding path 72 by the suction conveyer belt 52 and the pairs of delivery rollers 54 to 56, and the toner image on the photosensitive drum 21 is transferred to the reverse surface of the paper sheet when the paper sheet passes through the position of the transferring section 24. The paper sheet on which the toner image is transferred is separated from the photosensitive drum 21 by the separating section 25, and is conveyed by the conveyer belt 35 to the fixing device 36, where the toner image is fixed, after which the paper sheet is introduced into the pair of discharge rollers 39 after passing through the pair of delivery rollers 37 through the switching guide 38 which is returned to the discharge side, and is discharged to the paper discharge tray 40. A path from the sheet tray 51 to a primary paper feeding path 70 is the paper refeeding path 72.

A paper feeding detecting sensor 80 for detecting the passage of the paper sheet fed is disposed in a leading end portion of the primary paper feeding path 70 and in a position just on the upstream side of the pair of delivery rollers 32. Further, a first paper passage detecting sensor 81 for detecting the passage of the paper sheet is disposed in a final end portion of the stacking and conveying path 71 and in a position obliquely below the reversing roller 49. The first paper passage detecting sensor 81 detects the passage of the paper sheet immediately before being stacked on the sheet tray 51. In addition, a second paper passage detecting sensor 82 for detecting the passage of the paper sheet is disposed in a leading end portion of the paper refeeding path 72 and between the suction conveyer belt 52 and the pair of delivery rollers 54. The second paper passage detecting sensor 82 detects the passage of the paper sheet immediately after being fed again. Each of the sensors 80 to 82 is constituted by a photosensor, a limit switch or the like.

The detailed construction of the suction conveyer belt 52 and the air nozzle 53 in the paper refeeding device 50 will be described using FIG. 1 and FIG. 3 which is a cross sectional view taken along a line IV—IV shown in FIG. 1.

Figure 1:
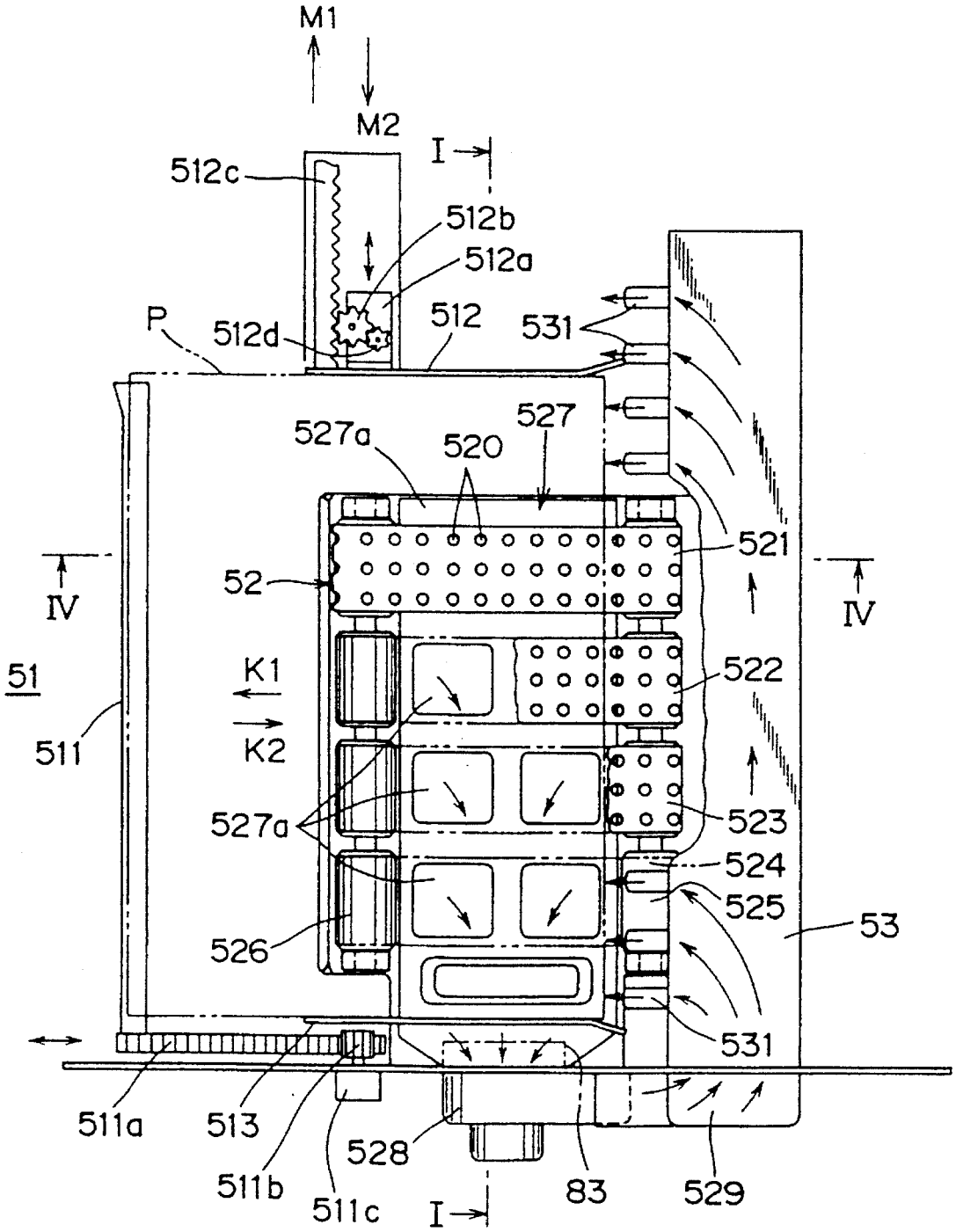
FIG. 1 is a partially cutaway plan view showing a paper refeeding device in a duplex copying machine according to one embodiment of the present invention.

Referring to FIG. 1, a paper leading end liner 511 automatically slid in the direction of conveyance (directions indicated by arrows K1 and K2) of the paper sheets P which are conveyed by the above described suction conveyer belt 52 depending on the set paper size for lining up the leading ends of the paper sheets P (the leading ends in a case where they are stacked and the trailing ends in a case where they are fed again) and a paper side end liner 512 automatically slid along the width of the paper sheets P depending on the set paper size for lining up both side ends of the paper sheets P are respectively disposed on the sheet tray 51 in order to line up the paper sheets P. Reference numeral 513 denotes a paper side end liner fixed to the sheet tray 51.

The above described paper leading end liner 511 is so adapted as to be slidable integrally with a rack 511*a* which is disposed in the direction of conveyance of the paper sheets P. A pinion 511*b* which is rotated by a motor 511*c* fixed to a side plate is engaged with the rack 511*a*. The paper leading end liner 511, along with the rack 511*a*, is slid to a required position corresponding to the paper size by the driving of the motor 511*c*.

Referring to FIG. 1, the above described paper side end liner 512, along with a mounting member 512*a* which is in an L shape in cross section, is slid in directions indicated by arrows M1 and M2 which are orthogonal to the directions of conveyance K1 and K2 of the paper sheets P. The above described mounting member 512*a* is slidably provided in the above described directions M1 and M2 by a rail mechanism and a known guiding mechanism constituted by a known liner motion bearing which are not illustrated. A pinion 512*b* is mounted on the mounting member 512*a* in a state where it is rotatable and movable integrally with the mounting member 512*a*. The pinion 512*b* is engaged with a rack 512*c* fixed to the sheet tray 51. In addition, a motor (not shown) for rotating the pinion 512*b* through a gear 512*d* is mounted on the mounting member 512*a*. The paper side end liner 512, along with the pinion 512*b* and the mounting member 512*a*, is slid to a required position corresponding to the paper size by the driving of the motor. Further, the paper side end liner 512 is moved back and forth between a lining position where it abuts against the side ends of the paper sheets to line up the side ends (see FIG. 1) and a separating position where it separates from the side ends of the paper sheets by a predetermined distance (for example, 5 mm) in the direction M2 in conformity with the conveyance of the paper sheets onto the sheet tray 51.

Figure 3:
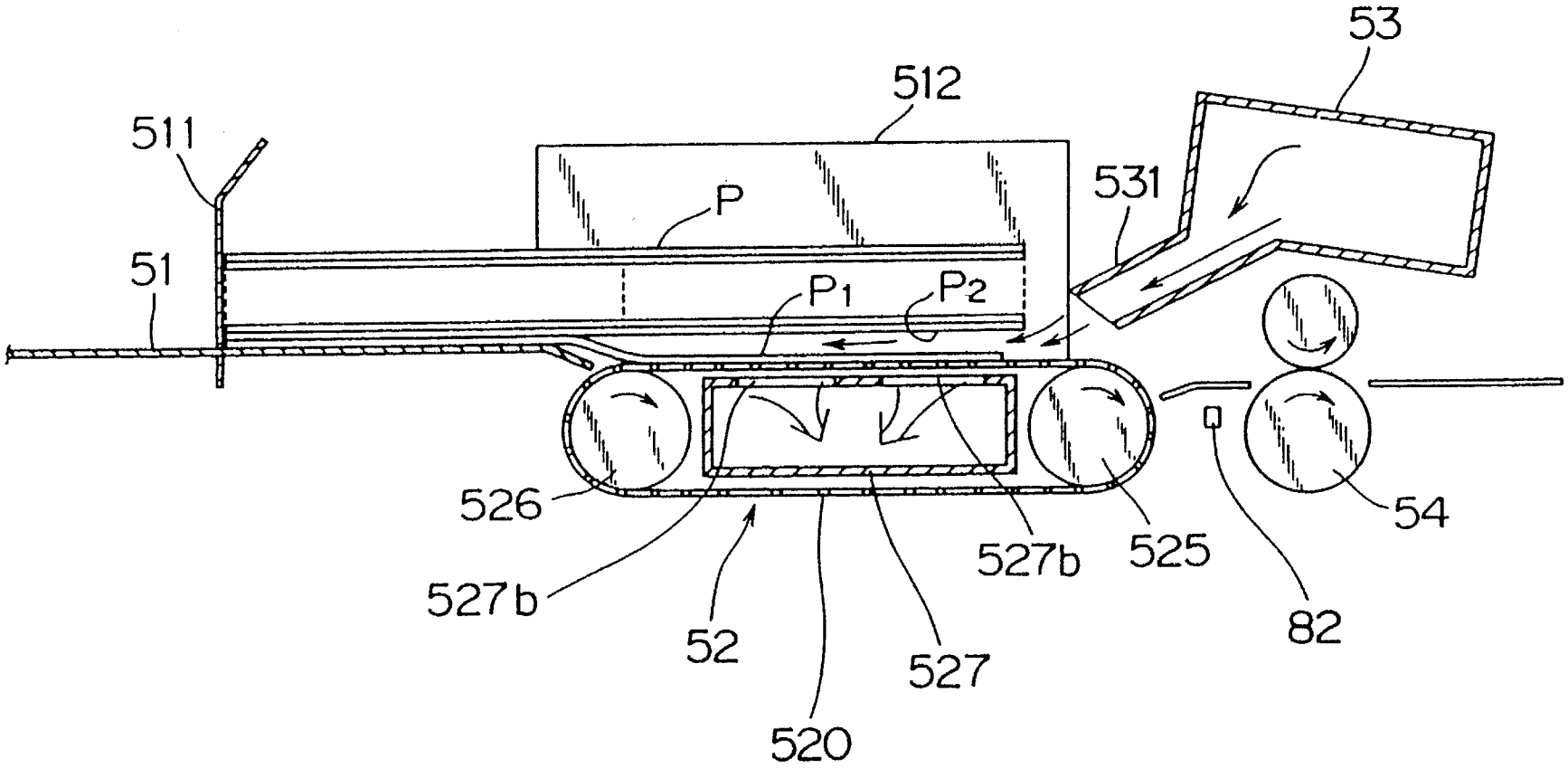
FIG. 3 is a cross sectional view taken along a line IV—IV shown in FIG. 1.

Referring to FIGS. 1 and 3, four suction conveyer belts 521 to 524 are disposed in parallel as the above described suction conveyer belt 52 along the width of the sheet tray 51. The suction conveyer belts 521 to 524 are stretched between a driving roller 525 and a driven roller 526. The suction conveyer belts 521 to 524 and the driving roller 525 and the driven roller 526 between which the suction conveyer belts 521 to 524 are stretched constitute conveyer belt means. Each of the suction conveyer belts 521 to 524 is provided with a plurality of small holes 520 regularly, for example. Further, a suction duct 527 in a hollow box shape is disposed between the driving roller 525 and the driven roller 526. A plurality of air suction ports 527*b* narrower than the suction conveyer belts 521 to 524 are provided on an upper surface 527*a* of the suction duct 527 and in positions opposed to the respective suction conveyer belts 521 to 524. The suction conveyer belts 521 to 524, the suction duct 527 and the suction fan 528 constitute sucking and conveying means.

A suction fan 528, which contains a fan motor, serving as sucking means is connected to one end surface of the suction duct 527. In addition, an air blowing fan 530 serving as air blowing means is mounted on a side plate adjacent to the suction fan 528. A portion of the air blowing fan 530 on the side of the exhaust of air is connected to the air nozzle 53. The air nozzle 53 is disposed on the downstream side of the sheet tray 51 in the direction of conveyance of the original. The air nozzle 53 has a plurality of air blow-off ports 531 arranged along the width of the sheet tray 51. Each of the air blow-off ports 531 is directed toward portions of the suction conveyer belts 521 to 524 on the side of the driving roller 525 and is so adapted as to blow air sent from the air blowing fan 530. In addition, the amount of air blown by the air blowing fan 530 is switched between a large amount of air and a small amount of air by a switching tap.

Furthermore, the upper surfaces of the suction conveyer belts 521 to 524 have steps from a surface of the sheet tray 51 on which the paper sheets are set and is so adapted as to cause a clearance between the lowermost paper sheet $P_1$ on the sheet tray 51 and the second lowermost paper sheet $P_2$ when the lowermost paper sheet $P_1$ is sucked through the air suction ports 527*b* of the suction duct 527 and the small holes 520 of the suction conveyer belts 521 to 524 so that the air from the air nozzle 53 enters the clearance. The second lowermost paper sheet $P_2$ and the subsequent paper sheets P are raised by the pressure of the air from the air nozzle 53, whereby the lowermost paper sheet $P_1$ is reliably separated from the remaining paper sheets, and only the lowermost paper sheet $P_1$ is conveyed by the suction conveyer belts 521 to 524.

Figure 4:
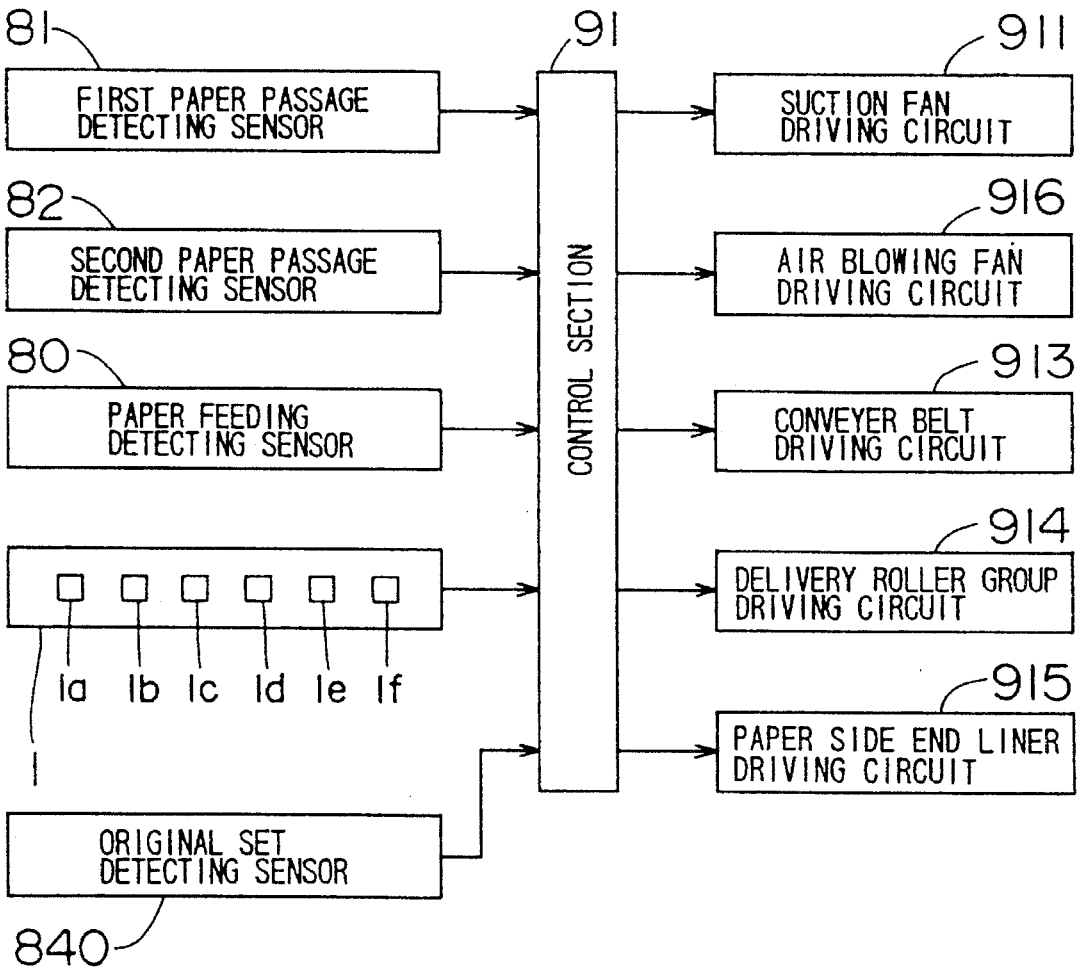
FIG. 4 is a block diagram showing the electrical construction of the copying machine.

FIG. 4 is a block diagram showing a control system of the duplex copying machine according to the present invention. The control system comprises a control section 91 for controlling the operations of respective portions by linking the operation of the main body of the duplex copying machine with the operation of the RADF 10. The control section 91 comprises a CPU, a ROM storing programs executed by the CPU, a RAM used as a work area, for example, of the CPU.

The operating section 1 comprises various types of key switches such as a start key 1*a* for instructing the start of a copying operation, an original number instructing key 1*b* for instructing the number of originals, a copy number instructing key 1*c* for instructing the number of copies, a paper size instructing key 1*d* for instructing the size of paper sheets, a copy mode instructing key 1*e* for instructing a copy mode such as a single copy mode or a duplex copy mode, and comprises a display portion 1*f* for displaying the contents of the operations of the key switches, for example.

The paper feeding detecting sensor 80, the first paper passage detecting sensor 81, the second paper passage detecting sensor 82, the operating section 1, and the original set detecting sensor 830 as described above are connected to the control section 91. Signals from the respective sensors 80 to 82 and the operating section 1 are inputted to the control section 91. Further, a suction fan driving circuit 911 for driving the suction fan 528, an air blowing fan driving circuit 916 for driving the air blowing fan 530, a conveyer belt driving circuit 913 for driving the suction conveyer belts 521 to 524, a delivery roller group driving circuit 914 for driving groups of delivery rollers 45 to 48 and 54 to 56, and a paper side end liner driving circuit 915 for driving the paper side end liner 512 are provided. The control section 91 controls the operations of the suction fan 528, the air blowing fan 530, the suction conveyer belts 521 to 524, the groups of delivery rollers 45 to 48 and 54 to 56, and the paper side end liner 512.

Figure 5:
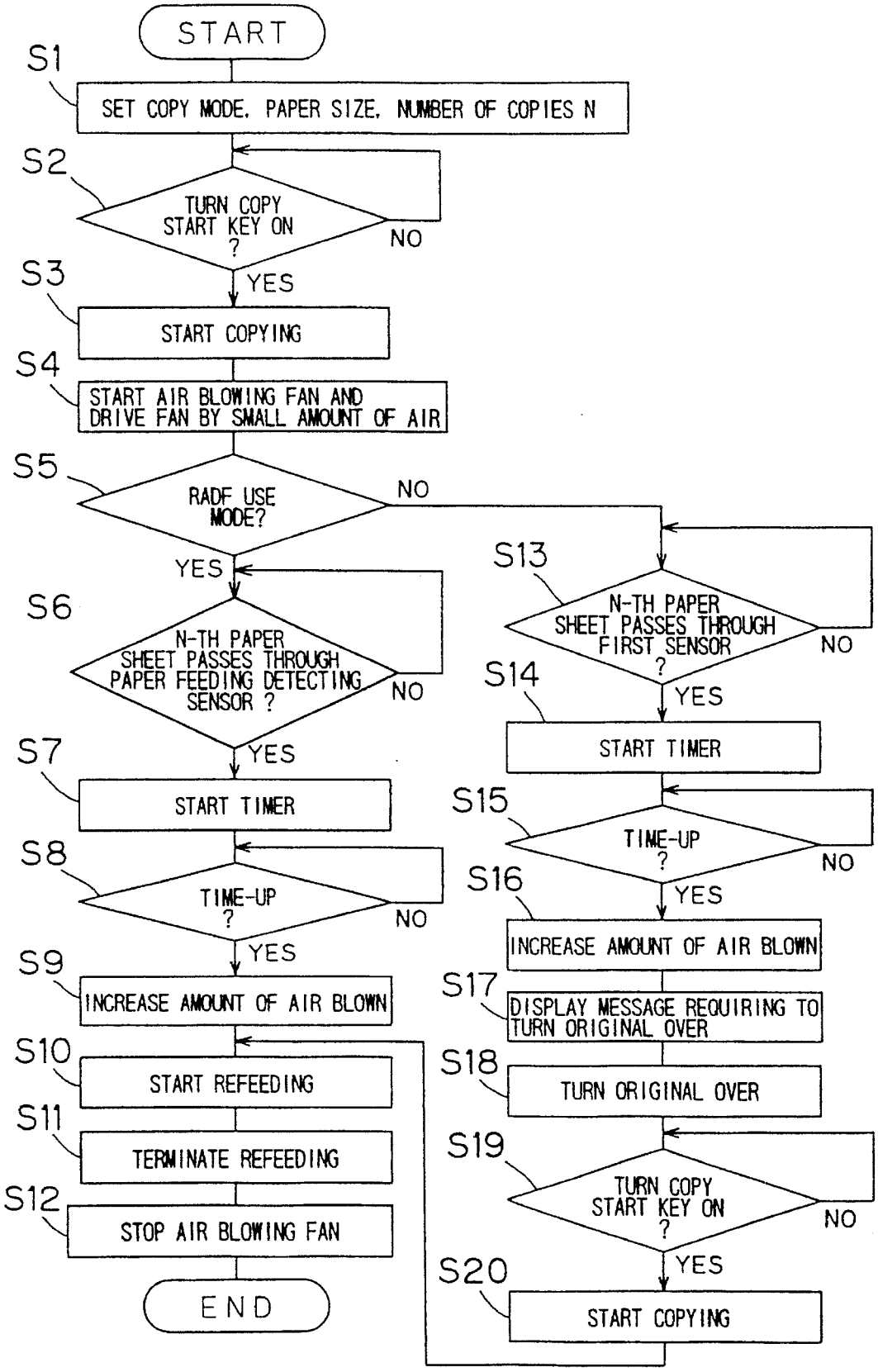
FIG. 5 is a flow chart showing the flow of control.
Figure 6:
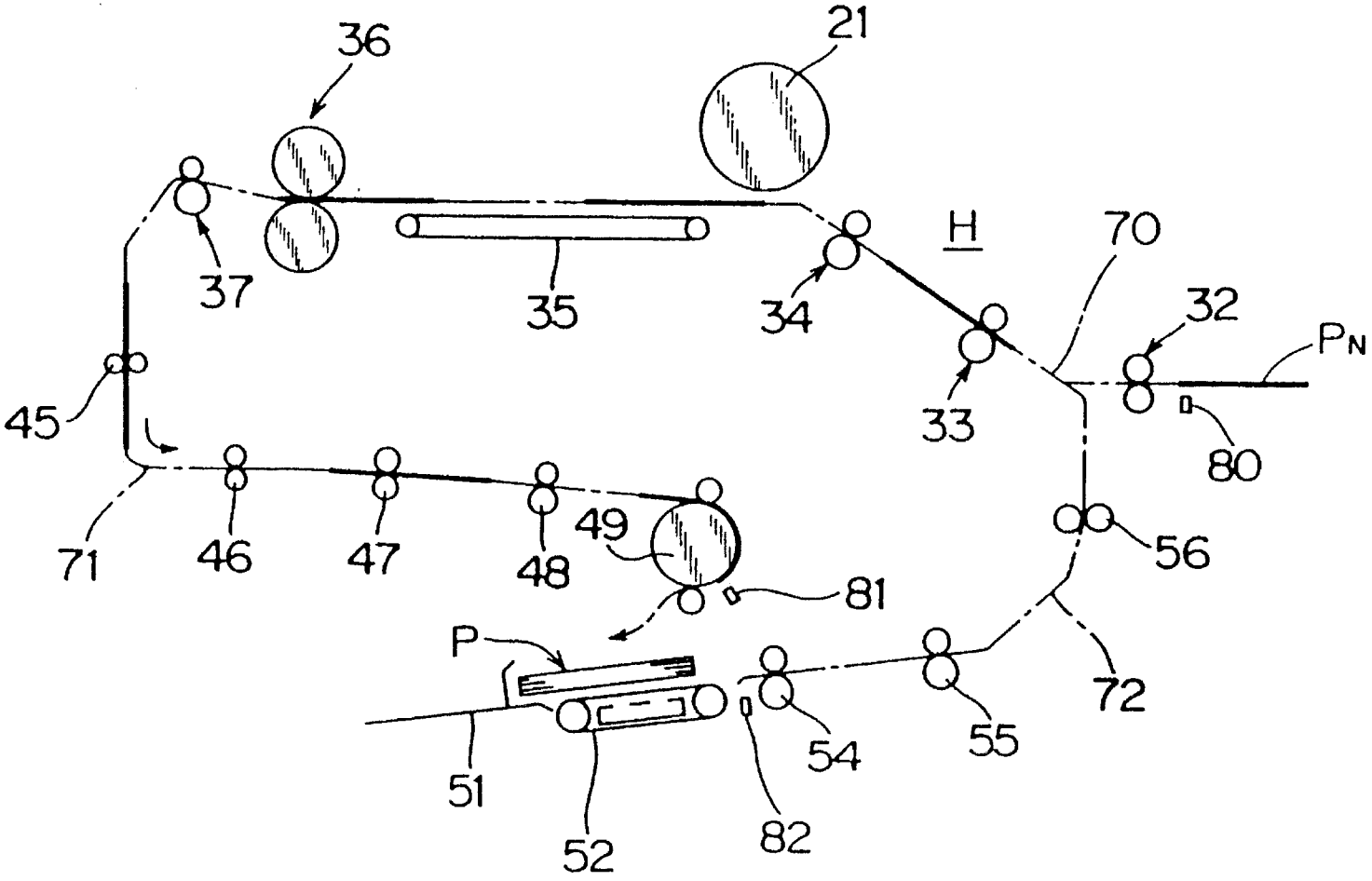
FIG. 6 is a schematic view showing a paper feeding path in a case where an automatic document feeder is used, which illustrates a state where the final paper sheet reaches a paper feeding detecting sensor.

Description is now made mainly of the flow of driving control of the air blowing fan 530 in accordance with the flow chart of FIG. 5.

If a worker first sets the number of copies N, the size of paper sheets, and a copy mode (a duplex copy mode or the like) by the copy number instructing key 1*c*, the paper size instructing key 1*d*, and the copy mode instructing key 1*e* in the operating section 1 (step S1), and then turns the copy start key 1*a* on (step S2), a copying operation is started (step S3), and the air blowing fan 530 is started and is driven by a small amount of air (step S4). A plurality of paper sheets are successively sent out at predetermined spacing (for example, approximately 100 mm to 180 mm) from the paper feeding sections 29 containing paper sheets of the set size by the start of the copying operation, and are sent to the image forming section R through the primary paper feeding path 70.

Figure 7:
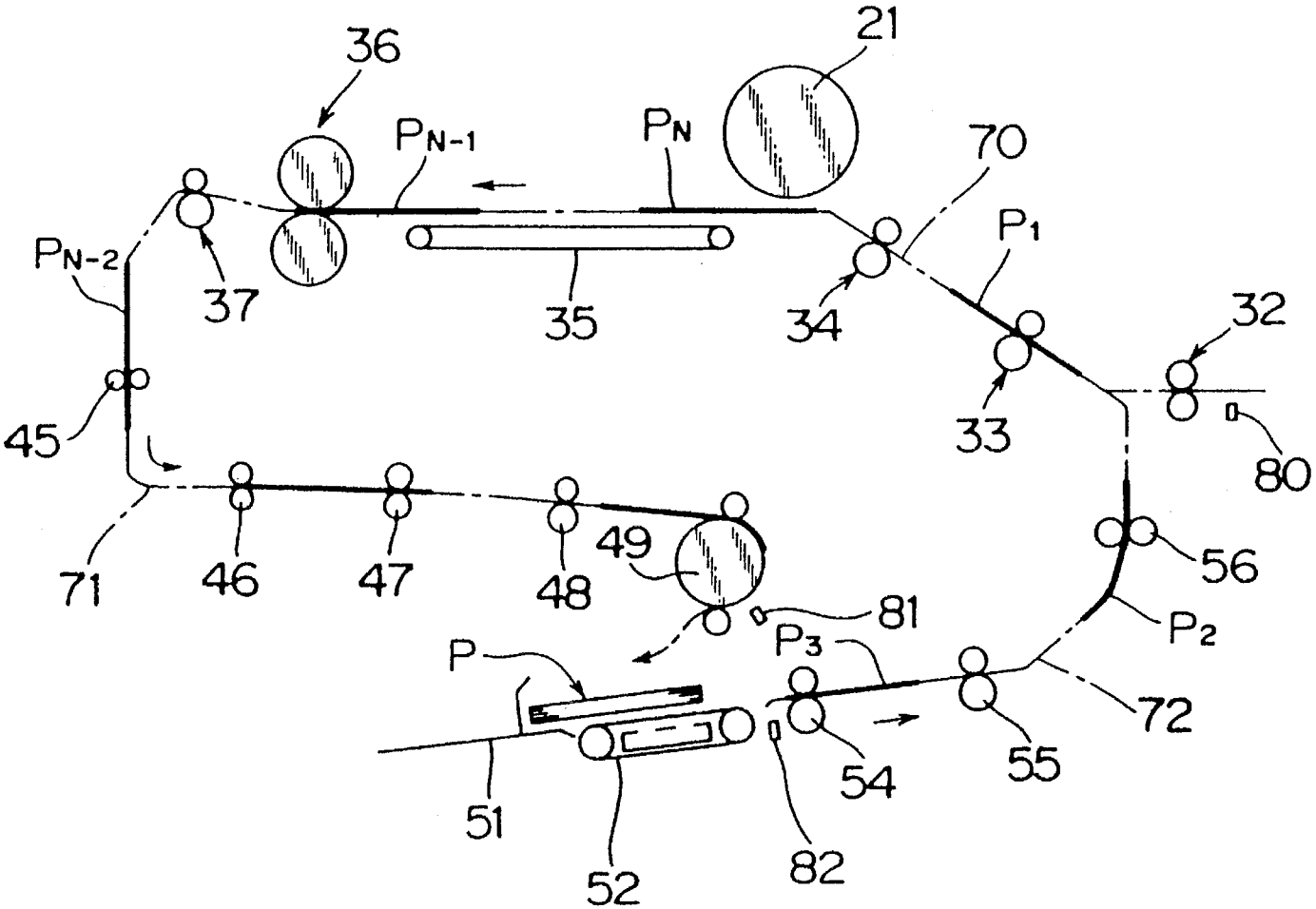
FIG. 7 is a schematic view showing a paper feeding path in a case where an automatic document feeder is used, which illustrates a state at the time of stacking feed where paper sheets are fed again while being stacked.

Distinction between a RADF use mode in which the RADF 10 is used and a non-use mode in which it is not used is then made on the basis of a signal from the original set detecting sensor 830 (step S5). In the RADF use mode in which the RADF 10 is used, the amount of air blown by the air blowing fan 530 is switched to a large amount of air (step S9) after a predetermined time period has elapsed from timing at which the final paper sheet $P_N$ passes through the paper feeding detecting sensor 80 (steps S6 to S8), after which the lowermost paper sheet $P_1$ out of the paper sheets is successively fed again (step S10). In this case, a stacking operation to the sheet tray 51 and a paper refeeding operation from the sheet tray 51 are simultaneously performed, as shown in FIG. 7. If the refeeding is terminated, the air blowing fan 530 is stopped (step S12), to terminate the processing.

Figure 8:
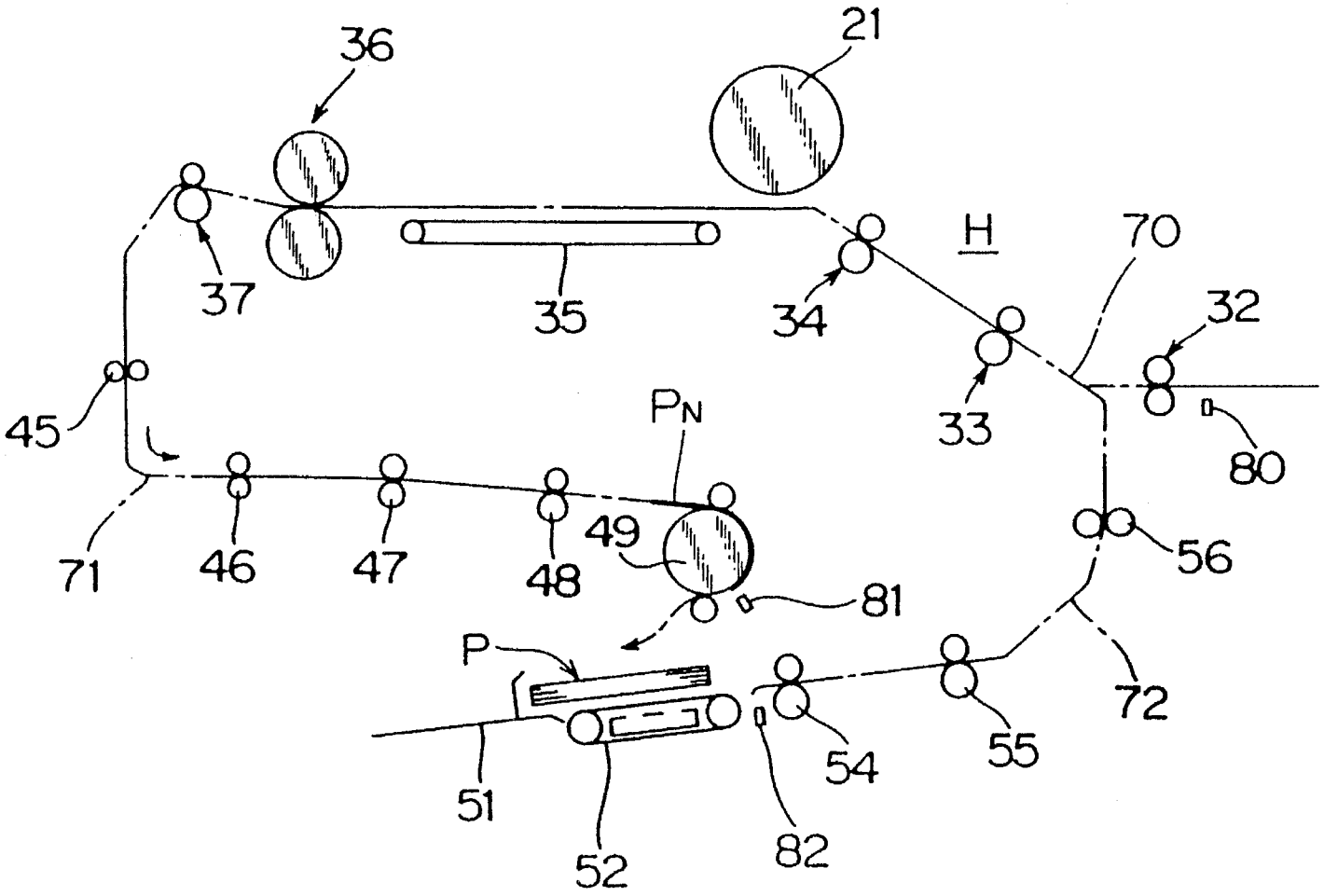
FIG. 8 is a schematic view showing a paper feeding path in a case where no automatic document feeder is used, which illustrates a state where the final paper sheet reaches a first paper passage detecting sensor.

On the other hand, in the non-use mode in which the RADF 10 is not used, the amount of air blown by the air blowing fan 530 is switched to a large amount of air (step S16) after a predetermined time period has elapsed from timing at which the final paper sheet $P_N$ passes through the first sensor 81 (see FIG. 8) (steps S13 to S15), and a message requiring to turn the originals over is displayed on the display portion 1*f* (step S17). If the start key 1*a* is turned on after turning the original over (steps S18 and S19), the copying is started (step S20), and the lowermost paper sheet $P_1$ out of the paper sheets is successively fed again (step S10).

Figure 9:
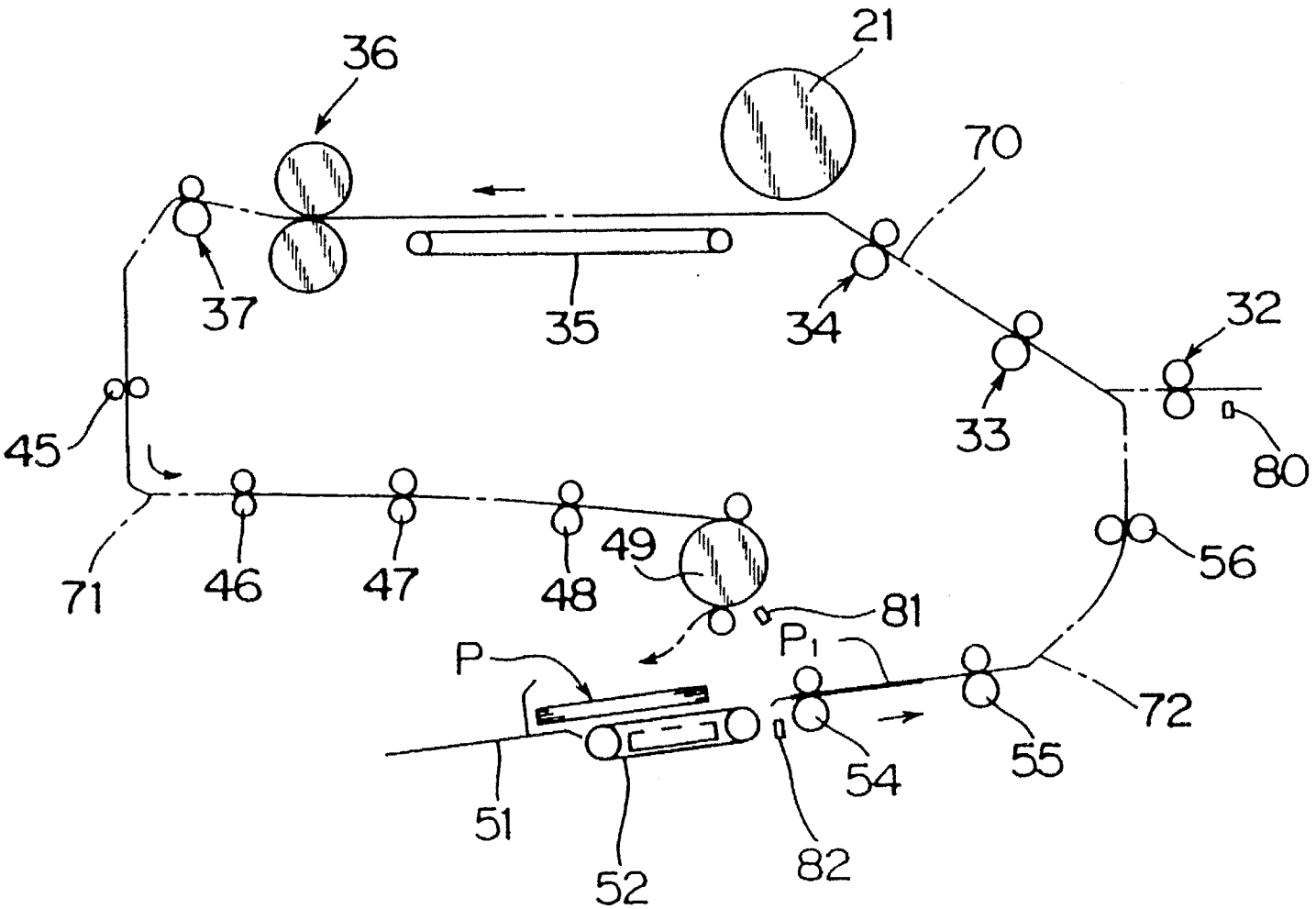
FIG. 9 is a schematic view showing a paper feeding path in a case where no automatic document feeder is used, which illustrates a state where paper refeeding is started after all paper sheets have been stacked.

Time-up timing in the step S15 is set at an amount which corresponds to a time that is immediately after the moment the final paper sheet $P_N$ has been stacked on the sheet tray 51. After the stacking operation on the sheet tray 51 is terminated, the paper refeeding operation from the sheet tray 51 is performed, as shown in FIG. 9. If the paper refeeding operation is terminated, the air blowing fan 530 is stopped (steps Sll and S12), to terminate the processing.

According to the present embodiment, the amount of air blown by the air blowing fan 530 in a case where the RADF 10 is not used and the paper sheets are being successively stacked is made smaller than the amount of air after starting the paper refeeding operation, whereby the blown air does not adversely affect the paper sheets which are being stacked. As a result, it is possible to prevent the paper sheets from being poorly stacked by the blown air. Moreover, the amount of air in a case where the paper sheets are being stacked is reduced. Therefore, power for driving the air blowing fan 530 can be reduced, as compared with a case where the amount of air before and after starting the paper refeeding operation is kept constant, which is useful in saving energy.

Furthermore, distinction between the RADF use mode or the non-use mode is made using the original set detecting sensor 830 for determining that an original is set on the original platen 11, whereby a sensor need not be separately provided, thereby to make it possible to reduce the manufacturing cost.

Although in the above described embodiment, the amount of air before the refeeding is a small amount of air, it may be zero with the air blowing fan 530 stopped. In this case the amount of air may be suddenly switched and raised to a large amount of air from zero. Also in this case, in the flow chart of FIG. 5, (1) the step S4 is eliminated, and (2) the steps S9 and S16 are changed into "an air blowing fan is started, and is driven by a large amount of air". Also in this case, the same function and effect as those in the above described embodiment are produced. Moreover, the air blowing fan 530 is stopped when the paper sheets are being stacked, which is further useful in saving energy. In this case, an operation for an operator to turn the originals over is performed when copying on one of the surfaces of the paper sheets is terminated, followed by copying on the reverse surfaces thereof. Accordingly, a predetermined time period is always required from the termination of the copying on one of the surfaces of the paper sheets to the start of the copying on the reverse surfaces thereof. Even if the air blowing fan 530 is stopped as described above, therefore, the amount of air can reach a predetermined amount of air before the refeeding is started, whereby there is no delay in the rise of the amount of air.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A duplex copying machine comprising:

an automatic document feeder for automatically conveying an original set on an original setting section to an exposed area;

a sheet feeder comprising i) a sheet tray on which a plurality of sheets each having an original image copied on its one surface are stacked, ii) air blowing means for blowing air on a leading end of a lowermost sheet out of said plurality of sheets stacked on said sheet tray to separate said lowermost sheet from the sheets above the lowermost sheet, and iii) conveyer belt means for successively conveying said separated lowermost sheet toward image forming means;

mode detecting means for discriminating between a use mode in which said automatic document feeder is used and a non-use mode in which it is not used; and air amount controlling means for making an amount of air blown by said air blowing means smaller than an amount of air in a case where the sheets are conveyed by said conveyer belt means when conditions under which the non-use mode is detected by said mode detecting means and the sheets are being at least stacked are satisfied.

2. The duplex copying machine according to claim 1, wherein said air amount controlling means makes the amount of air blown by said air blowing means zero when said conditions are satisfied.

3. The duplex copying machine according to claim 1, wherein said mode detecting means determines that the original is set on said original setting section.

4. The duplex copying machine according to claim 1, further comprising sheet passage detecting means for detecting a passage of the sheets to be stacked on said sheet tray, said air amount controlling means determining whether or not the sheets are being stacked based upon a detection of the passage of the sheets by said sheet passage detecting means.

* * * * *